US007213948B2

(12) United States Patent
Hein

(10) Patent No.: US 7,213,948 B2
(45) Date of Patent: May 8, 2007

(54) OPTICAL REFLECTOR

(75) Inventor: William A. Hein, Manhattan Beach, CA (US)

(73) Assignee: Visionaire Lighting, Gardena, CA (US)

( * ) Notice: Subject to any disclaimer, the term of this patent is extended or adjusted under 35 U.S.C. 154(b) by 42 days.

(21) Appl. No.: 11/066,376

(22) Filed: Feb. 25, 2005

(65) Prior Publication Data

US 2006/0193135 A1 Aug. 31, 2006

(51) Int. Cl.
*F21S 8/04* (2006.01)

(52) U.S. Cl. ..... 362/346; 362/297

(58) Field of Classification Search ..... 362/346, 362/297, 347, 301, 348, 349, 350; 359/850, 359/851, 853
See application file for complete search history.

(56) References Cited

U.S. PATENT DOCUMENTS

| | | | | |
|---|---|---|---|---|
| 261,768 | A * | 7/1882 | Schilling | 362/346 |
| 4,081,667 | A | 3/1978 | Lewin et al. | |
| 4,241,393 | A | 12/1980 | Olson | |
| 4,242,727 | A * | 12/1980 | deVos et al. | 362/346 |
| 4,447,865 | A | 5/1984 | VanHorn et al. | |
| 4,855,886 | A | 8/1989 | Eijkelenboom et al. | |
| 4,914,557 | A * | 4/1990 | Maassen et al. | 362/305 |
| 6,036,338 | A | 3/2000 | Gordin | |
| 6,123,436 | A | 9/2000 | Hough et al. | |
| 6,203,176 | B1 | 3/2001 | Gordin | |
| 6,252,338 | B1 * | 6/2001 | Bergman et al. | 313/113 |
| 6,338,564 | B1 | 1/2002 | Jordan et al. | |
| 6,447,147 | B1 | 9/2002 | Kramer et al. | |
| 6,464,378 | B1 * | 10/2002 | Reed et al. | 362/320 |
| 6,494,596 | B1 | 12/2002 | Burroughs | |
| 6,561,675 | B1 | 5/2003 | Kavanagh | |
| 6,637,912 | B2 | 10/2003 | Arumugasaamy et al. | |
| 6,698,908 | B2 | 3/2004 | Sitzema, Jr. et al. | |
| 6,726,345 | B2 | 4/2004 | Arumugusaamy et al. | |
| 2002/0181237 | A1 | 12/2002 | Liang | |
| 2003/0058652 | A1 | 3/2003 | Arumugusaamy et al. | |

* cited by examiner

*Primary Examiner*—Sandra O'Shea
*Assistant Examiner*—Sharon Payne
(74) *Attorney, Agent, or Firm*—Fulwider Patton LLP

(57) ABSTRACT

Disclosed is a reflector for a lighting assembly comprised of a series of discrete facets connected to form an optical reflector. Each facet includes subdivisions that extend uninterrupted along substantially the length of the facet and serve to multiply the image of the light source for increased illumination. Further, the curvature of the facets are selected to maximize the length of the reflected image of the light source to further enhance optical output.

2 Claims, 4 Drawing Sheets

OPTICAL REFLECTOR

FIELD OF THE INVENTION

The present invention relates to lighting assemblies, and more particularly to a lighting assembly with a reflector that optimizes illumination using enhancement of the virtual image of the illumination source.

BACKGROUND OF THE INVENTION

Outdoor lighting assemblies are well known in the art and can be found in areas requiring overhead lighting such as parking lots, parks, public walkways, and outdoor shopping areas. Outdoor luminaries typically provide light from above, positioned on buildings, poles, masts or other means of support. Design of such overhead lighting should provide easy access for repair and replacement and be aesthetically pleasing while providing the necessary illumination.

Outdoor luminaries typically include a housing or base, an electrical system, and an optical assembly. The housing is usually exposed to the environment and encloses the electrical circuitry, and thus must be capable of protecting the electrical system from moisture and debris. The optical assembly contains a lamp for producing the light and a reflector that directs the light in a predetermined direction. Using different reflector configurations, luminaries are capable of different light distribution patterns such as symmetrical and asymmetrical. These light distribution patterns can be especially suited for roadway, parking and area applications. Lights that provide greater illumination for a given power input are obviously favored, and higher illumination outputs can reduce the number of required lights by increasing the spacing between lights. Depending on the height of the lighting fixture, the beam or area of illumination can be varied to adjust the primary lighting area. In every application, however, greater illumination can offset costs by reducing the number of lights and the wattage of the lights for a given illumination.

The primary emphasis of such lighting is the reflector, which takes many forms and arrangements. Reflectors can be manufactured from metals such as aluminum or polished steel, and can be painted, plated or applied with a chemical surface treatment to brighten the reflective surface. Other techniques for preparing a reflective surface include vacuum deposition or metalizing, and chemical or vapor deposition. These techniques apply a thin layer of metal or other reflective material on the surface of the reflector. There are also prismatic internal reflection glass and plastic reflectors that use the index of refraction to control the reflectance of light and redirect it into a distribution of light. Some glass reflectors are known to use a metal cover spun around the exterior to eliminate uplight, radiated by the large rounded portion of their prism peaks and roots, and the cover is used as a means of glare control and to maintain a clean exterior internal reflection surface.

U.S. Pat. No. 6,726,345 to Arumugusaamy et at. discloses an open type luminaire lens including non-circular reflective lens having a metalized exterior surface and a prism section, the non-circular reflective lens having a shape generally defined by the combination of two parabolas, the prism section including an array of external reflecting prisms of varying predetermined shapes and varying predetermined sizes for use in providing a desired light distribution. This disclosure proposes an aluminum coating directly deposited on an outer section of an elliptical lens.

U.S. Pat. No. 6,123,436 to Hough et al. discloses a reflector with an input aperture positioned near a point of minimum focus and has an output aperture that is larger than the input aperture. The surface is shaped to decrease the angles of incident light rays from the reflector so that an emerging light beam is bounded by a cone the angle of which is less than or equal to the acceptance cone of a projection lens.

U.S. Pat. No. 6,698,908 to Sitzema Jr. et al. discloses an improved optical assembly that includes a reflector device and a reflector collar for enhanced directional illumination control. The reflector/refractor has a predefined shape and has a plurality of prisms on an exterior body surface for reflecting and refracting light. The predetermined contour and the plurality of reflector impressions provide directional illumination control.

U.S. Pat. No. 6,494,596 to Burroughs discloses a reflector for a lighting fixture comprising a substantially bell shaped reflector wall with top and bottom openings and a substantially parabolic cross-section. The reflector wall includes an inner surface having a first top portion that is textured for diffusing light rays from the light source of the fixture, and a second bottom portion that has a smooth surface allowing the light rays to pass through the reflector. The reflector wall also has an outer surface with a plurality of curvilinear prisms for reflecting the light rays.

SUMMARY OF THE INVENTION

A reflector assembly for a light comprises of a series of discrete curved facets connected together to form an optical reflector. Each facet includes elongated vertical strips or subdivisions that extend uninterrupted along substantially the height of the facet and serve to multiply the image of the light source for increased illumination. Further, the curvature of the facets is selected to maximize the length of the reflected image of the light source to further enhance optical output.

Other features and advantages of the invention will become apparent from the following detailed description, taken in conjunction with the accompanying drawings which illustrate, by way of example, the features of the invention.

DETAILED DESCRIPTION OF THE INVENTION

Figure 2:
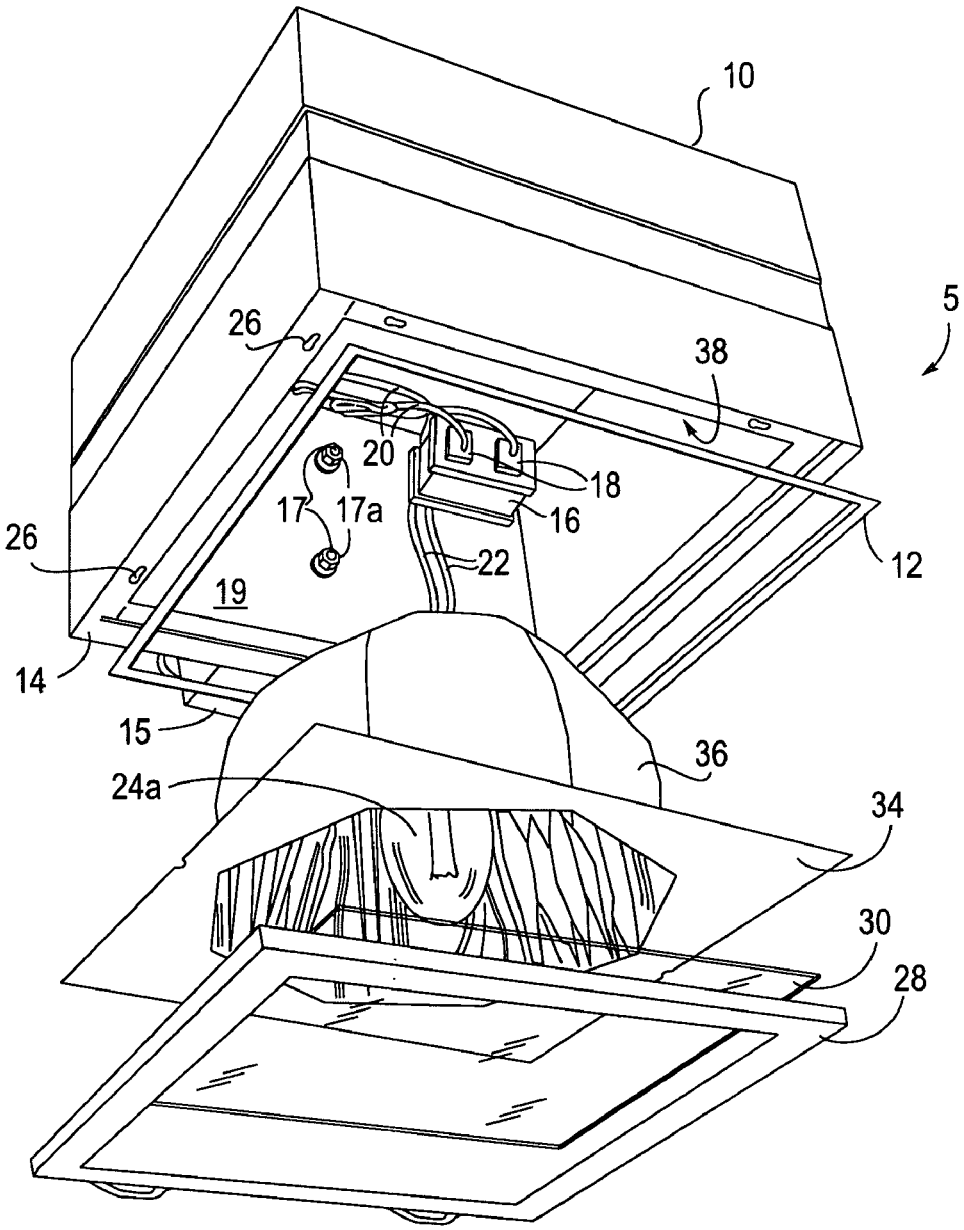
FIG. 2 is an exploded view of a light assembly using the reflector assembly of FIG. 1.
Figure 3:
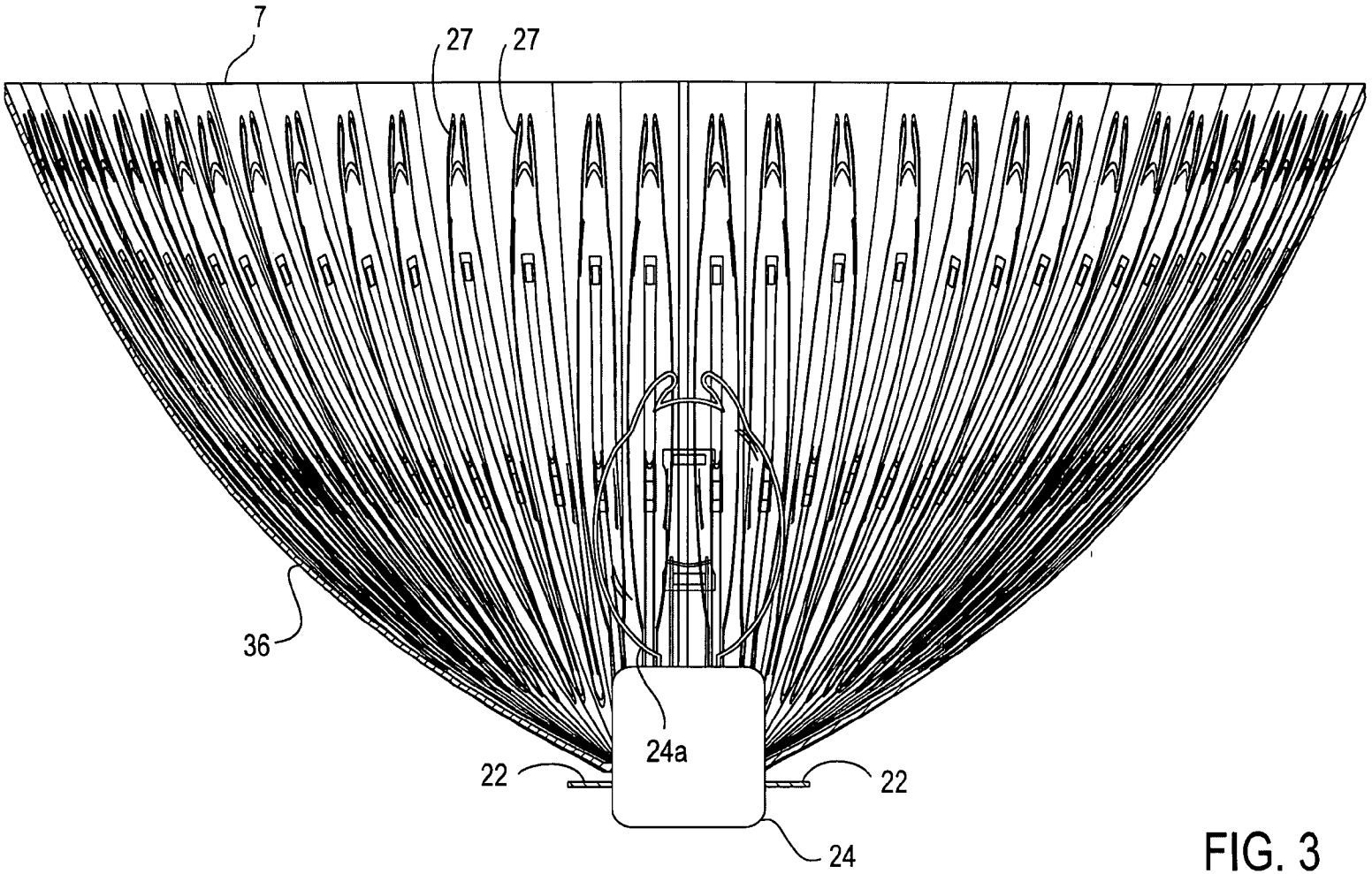
FIG. 3 is a cross sectional view of the reflector of FIG. 1.

The lighting fixture 5 including the reflector of the present invention is generally illustrated in FIG. 2. A housing 10 encases the reflector assembly and is formed of a sturdy, light weight material that can shield the electrical components from weather, moisture, dirt and other contaminants. The housing 10 is shown as rectangular although the particular shape of the housing is not critical to the present invention. The housing 10 further comprises an electrical plug or other coupling 15 for connecting the lighting fixture electrically to a power supply (not shown), mounted to the housing by threaded fasteners 17 passing through the housing rear wall 19 and secured by lock nuts 17*a*. Inside the cavity of the housing 10 is a transformer 16 or other electrical converted to reduce the standard AC power to a more productive power, and includes electrical connectors 18 that complete an electrical current conduit with a remote source via cables 20 to power the light. Electrical wires 22 connect a lamp assembly 24 to the transformer 16 forming the electrical circuit that provides current to the bulb 24*a*. The lamp assembly 24 is standard and may include an incandescent bulb of known wattage and illumination powered by the aforementioned electrical circuit. However, as shown in FIG. 3 the length of the bulb 24*a* when configured in the reflector assembly 32 is somewhat shorter than the depth of the reflector assembly cavity. As will be explained in more detail below, the shape and curvature of the reflector assembly "stretches" or extends the image of the bulb such that the virtual or reflected image is commensurate with the length of each reflector panel to maximize the reflected light and enhance the illumination performance of the reflector. This is seen in FIG. 3, where the reflected images 27 of bulb 24*a* in the vertical segments of the reflector's inner surface 29 extend longitudinally to the edge 7 of the reflector 36. This elongation of the virtual image 27 of the bulb 24*a* is accomplished through selective shaping of the individual facets that make up the reflector assembly, and leads to improved illumination output of the reflector 36.

At the base of the housing 10 is a downwardly directed lower rim 14 including holes 26 for receiving fasteners (not shown) that connect the cover plate 28 to the housing 10. A resilient seal 12 is preferably compressed between the lower rim 14 of the housing 10 and the cover plate 28 via pressure from the fasteners to form a weather-proof seal that prevents moisture from collecting in the housing. The seal 12 can be made of any suitable polymeric material that is easily compressed between the housing and the cover plate to shield moisture from entering the housing 10.

The cover plate 28 may fit over and secure a protective glass or plastic lens 30, or the cover plate 28 can be formed integrally with the lens in a single unit. The lens 30 fits over and engages a peripheral skirt 34 of a reflector assembly 36 described in more detail below. The reflector assembly 36 is received in the cavity 38 of the housing 10, and secured by the cover plate's 28 engagement with the lower rim 14 of the housing 10. The lighting fixture 5 is customarily mounted to a light pole or overhead structure with electrical connections that connect with the cables 20 to support and power the lighting fixture at some elevated position.

Figure 1:
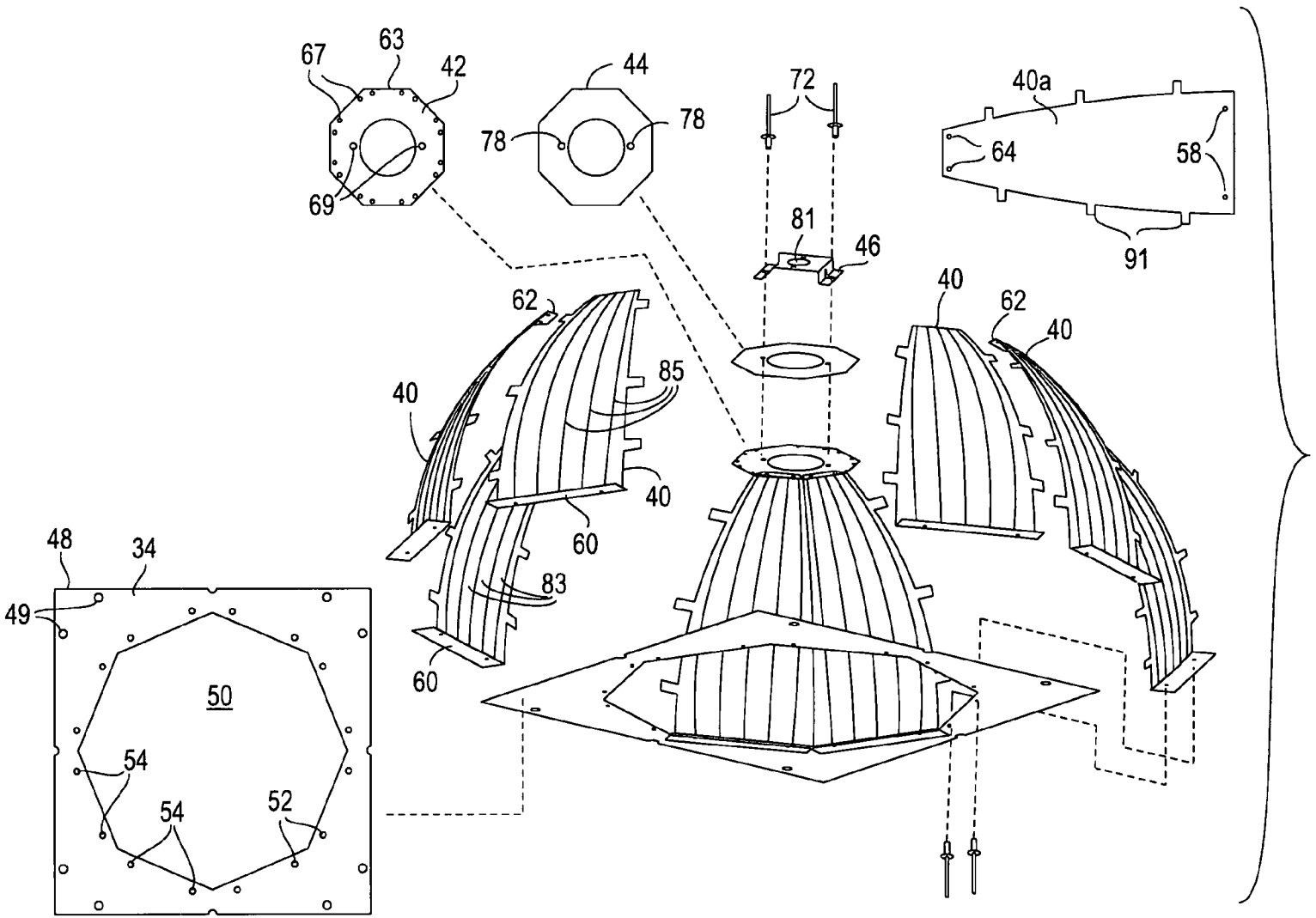
FIG. 1 is an exploded view of one preferred embodiment of the reflector assembly of the present invention.

FIG. 1 shows an exploded view of the reflector assembly 36 comprising a skirt 34, eight discrete facets 40, a top plate 42, a cover plate 44, and a bracket 46. The skirt 34 is formed of a thin plate of aluminum, steel, or other sturdy material having an outer perimeter 48 matched to the shape of the inner cavity 38 of the housing 10 (e.g., square) and having a polygonal window 50 formed in the skirt interior. The skirt 34 may include holes 49 that coincide with the holes 26 on the rim 14 of the housing 10 to also receive fasteners coupling the cover plate 28 to the housing 10. Additionally, the inner edges 52 defining the perimeter of skirt window 50 each include an adjacent pair of apertures 54 that receive a fastener such as a rivet for coupling the facets 40 to the skirt 34. The skirt 34 is a stand alone component that connects to the individual facets 40 at the apertures 54 to form a lower structural base of the reflector assembly 36.

Each individual facet 40 is formed from a curved plate and is shown in plan form in FIG. 1. Two apertures 58 coincide with apertures 54 on the skirt to receive a pair of rivets that couple the facet 40 to the skirt 35. A traverse lip or flap 60 is bent 90° into a parallel relationship with the skirt 34 so as to form a mating surface therebetween. With the mating surface of the traverse flap 60 in engagement with the upper surface of the skirt 34 at a respective edge 52, the apertures 58 on the flap 60 coincide with the apertures 54 on the skirt 34 to align the respective surfaces and permit coupling with the rivets that bind the two surfaces. A top plate 42 similarly collects the upper surfaces of the respective facets 40. Each facet 40 has a second traverse flap 62 that is bent approximately 38° to mate with an outer edge 63 of the top plate 42, where a pair of apertures 64 on the traverse flap 62 of each facet coincide with a pair of apertures 67 on the periphery of the top plate 42 and a pair of fasteners such as rivets (not shown) couple the facets 40 to the top plate 42. As with the traverse flap 60, the traverse flap 62 is bent into a parallel relationship with the top plate 42 so as to form a mating surface therebetween. Also, because the facets 40 engage the outer edges 63 of the top plate 42, the top plate perimeter will have a shape corresponding to the shape of the window 50 in the skirt 35. That is, if there are eight facets suggesting an octagon as shown in FIG. 1, then the window 50 and the perimeter of the top plate 42 will be octagons. If there are six facets or seven facets, the shapes would be hexagons or heptagons, respectively.

The top plate 42 includes two holes 69, and the cover plate 44 includes two holes 78, that receive threaded fasteners 72 for securing the top plate 42, cover plate 44, and mounting bracket 46. The mounting bracket 46 includes a circular opening 81 that receives the bulb 24*a* for supporting the bulb in the reflector assembly.

Each facet 40 is preliminarily punched, cut, or otherwise formed from a flat plate 40*a*, whereupon traverse flaps 60, 62 are formed by bending the plate at the appropriate angles (90° and 38°, respectively). The facet is also subdivided into horizontal subsections 83 that extend from the top vertical flap 62 to the bottom vertical flap 60 in an uninterrupted manner to form a smooth surface. The subdivisions can be created by forming 5° angles at each intersection 85 of the subdivisions 83, which adds a curvature to the facet in the horizontal direction. The facets 40 are further curved into a parabolic shape in the vertical direction to expand and lengthen the reflected image of the bulb 24*a*, thereby increasing the illumination factor of the overall reflector assembly. Each facet is further formed with bendable tabs 91 that engage the back side of an adjacent facet to couple the facets together. Using the bendable tabs 91, the reflector assembly can be shipped in a smaller compartment and quickly assembled without fasteners, adhesives, or other complicated joining methods. Each tab 91 is bent behind the adjacent facet, and the combination of tabs 91 lock the reflector in place. Once assembled, the skirt 34 and top plate 42 can be secured to the respective flaps 60, 62 to fix the reflector assembly. Fasteners 72 then pass through cover plate 44 and top plate 42 to tighten and rigidly join the reflector assembly into a single unit.

In FIG. 3, it can be seen that the discrete facets form multiple subdivisions, each subdivision reflecting a separate, elongate image of the illumination source. This multiplied virtual image of the illumination source, concentrated into each subdivision, has the effect of enhancing the illumination output of the reflector over a simple parabolic reflector. Each subdivision is a smooth, continuous surface from the top of the facet to the bottom, producing a clean image of the illumination source. Further, the reflected image is elongated to extend substantially the height of the subdivision due to the curvature of the facet in the vertical direction. Thus, the reflector by virtue of the multiplication of the virtual image and the elongation of the virtual image in each facet enhances the illumination output over standard lighting assemblies.

Figure 4:
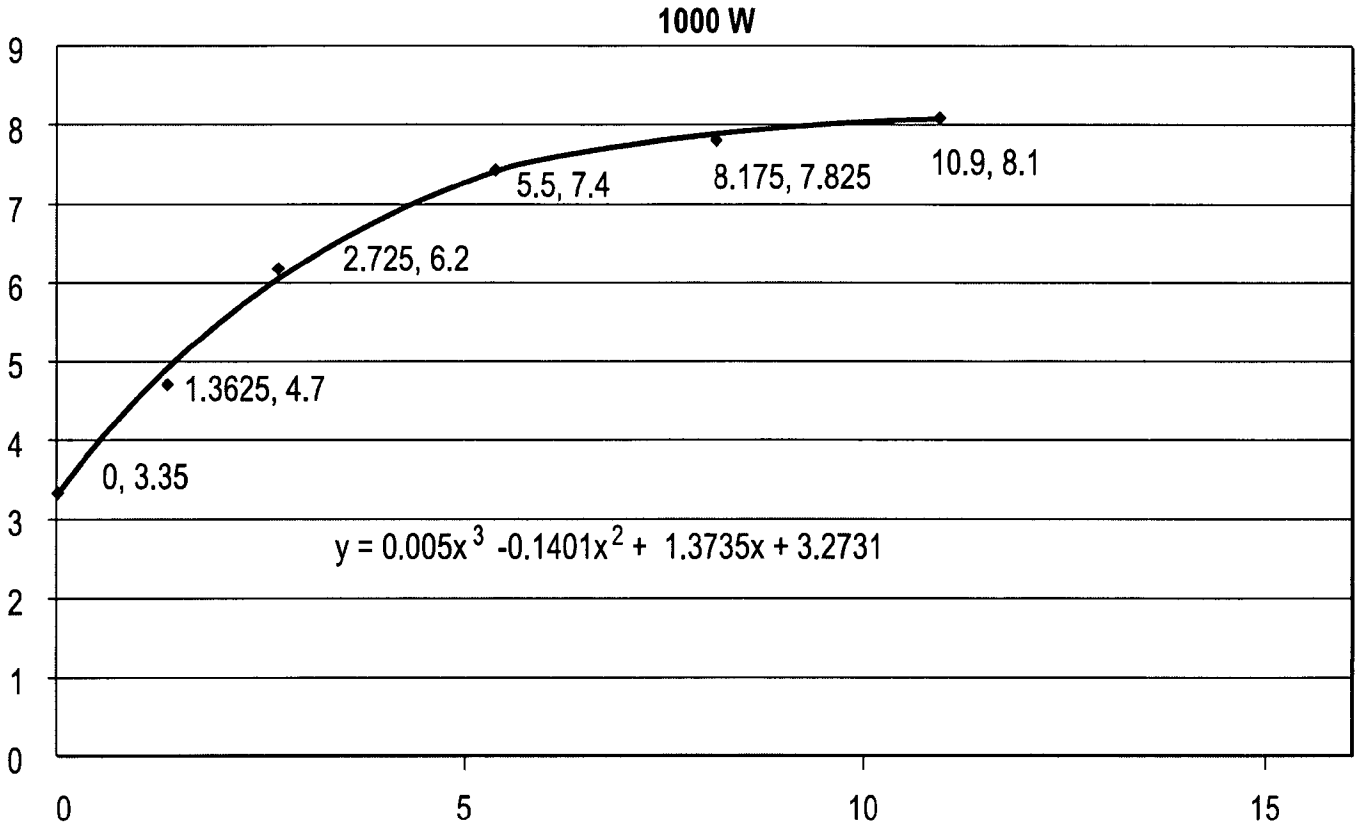
FIG. 4 is a plot of a reflector curvature in accordance with the teachings of the present invention.

A plot of a curvature for the of the radius of the reflector of the present invention can vary with application and illumination source. For a given 1000 watt illumination source, FIG. 4 illustrates a graphic representation of the radius versus axial length of the reflector. As shown, y (the radius of the reflector) is approximated by the third order polynomial $$y=0.005x^3-0.1401x^2+1.3735x+3.2731$$

where x is the axial distance along the reflector moving away from the illumination source. The two tables below present x versus y points for reflectors using 1000 watts and 400 watt illumination sources.

TABLE 1

| | 1000 W | | 4000 W | |
|---|---|---|---|---|
| | x | y | x | y |
| 0 | 0 | 3.35 | 0 | 2.45 |
| ⅛ | 1.3625 | 4.7 | 1.2 | 4.14 |
| ¼ | 2.725 | 6.2 | 2.41 | 5.26 |
| ½ | 5.45 | 7.438 | 4.81 | 6.61 |
| ¾ | 8.175 | 7.825 | 7.22 | 7.21 |
| 1.0 | 10.9 | 8.1 | 9.63 | 7.21 |

EXAMPLE 1

In a parking lot test where light poles and light fixtures are located in the interior of the parking lot with double parking island spacing (120'×120') with fixtures mounted at thirty-three feet above grade and four fixture heads per pole of equal wattage (400 watts), the present invention with an eight facet reflector displayed a 58% higher foot candle average, 76% more foot candles in the center of the grid between the four poles, and 35% more foot candles between poles than a comparable segmented reflector.

EXAMPLE 2

In a parking lot test where light poles and light fixtures are located in the interior of the parking lot with triple parking island spacing (180'×180') with fixtures mounted at forty-two feet above grade and four fixture heads per pole of equal wattage (1000 watts), the present invention with an eight facet reflector displayed a 36% higher foot candle average, 50% more foot candles in the center of the grid between the four poles, and 24% more foot candles between the poles than a comparable segmented reflector.

EXAMPLE 3

In a parking lot test where light poles and fixtures are located on the perimeter of the parking lot with fixtures mounted at thirty-three feet above grade and one fixture head per light pole of 400 watts, the present invention with seven facets (heptagonal) displayed a 38% higher foot candle average, 57% more foot candles in the center of the grid between the four poles, and 28% more foot candles between the poles than a comparable segmented reflector.

EXAMPLE 4

In a parking lot test where light poles and fixtures are located on the perimeter of the parking lot with fixtures mounted at thirty-three feet above grade and one fixture head per light pole of 1000 watts, the present invention with seven facets (heptagonal) displayed a 62% higher foot candle average, and a maximum to minimum uniformity level that was three times as uniform than a comparable segmented reflector.

As the examples show, the present invention provides superior lighting characteristics that will save planners and developers costs by having more efficient lighting than previously possible. As the number of light poles is reduced due to enhanced lighting, greater energy saving and less clutter due to more light poses is realized. Reduced energy demands also lead to less pollution, less stress on local energy grids, and savings on installation costs of parking lots and the like.

The foregoing discussion is meant to be illustrative of the present invention but not limiting in its scope. All terms herein are used according to their ordinary usage, and the examples discussed herein should not be deemed limiting to the invention. Those of ordinary skill in the art will recognize that many variations to those described embodiments will operate in a like manner, and the scope of the invention is intended to cover all variations so recognized. Therefore, the scope of the invention is properly determined by the claims presented below, using the ordinary meanings of terms set forth therein.

I claim:

1. A reflector assembly comprising:

a planar skirt formed with a polygon-shaped window;

a base including an aperture for receiving an illumination source; and a generally curved reflector formed by a plurality of discrete concave facets arranged side-by-side in a closed configuration, each facet including a plurality of non-intersecting longitudinal surface discontinuities extending substantially between first and second ends of said facet on a concave side for forming multiple elongate reflecting surfaces thereon, said reflecting surfaces having a smooth, uninterrupted continuous curvature between said base and the planar skirt selected to exaggerate a reflected image of a light source to a length greater than a length of said light source, and wherein said facets further include a first transverse flap at said first end and extending substantially a length of said first end in registration with a respective side of said polygon-shaped window and a second transverse flap at said second end and extending substantially a length of said second end in registration with said base.

2. A reflector for a lighting assembly formed by a plurality of discrete concave facets arranged side-by-side, each facet including a plurality of non-intersecting longitudinal surface discontinuities extending substantially between first and second ends of said facet on a concave side for forming multiple elongate reflecting surfaces thereon, said reflecting surfaces having a continuous, uninterrupted curvature in a longitudinal direction between said first and second ends selected to exaggerate a reflected image of a light source to a length greater than a length of said light source, and each facet further including bendable tabs on each side for interlocking adjacent facets together.

* * * * *